US007366283B2

(12) United States Patent
Carlson et al.

(10) Patent No.: US 7,366,283 B2
(45) Date of Patent: Apr. 29, 2008

(54) METHOD TO CONTROL ANODIC CURRENT IN AN X-RAY SOURCE

(75) Inventors: Todd R. Carlson, Glenview, IL (US); John J. Gregorio, Chana, IL (US); Roberto Molteni, Arlington Heights, IL (US)

(73) Assignee: Gendex Corporation, Washington, DC (US)

( * ) Notice: Subject to any disclaimer, the term of this patent is extended or adjusted under 35 U.S.C. 154(b) by 85 days.

(21) Appl. No.: 11/277,672

(22) Filed: Mar. 28, 2006

(65) Prior Publication Data

US 2007/0237299 A1 Oct. 11, 2007

(51) Int. Cl.
*H05G 1/44* (2006.01)
*H05G 1/34* (2006.01)

(52) U.S. Cl. ..... 378/108; 378/110; 378/112

(58) Field of Classification Search ..... 378/108, 378/110, 112

See application file for complete search history.

(56) References Cited

U.S. PATENT DOCUMENTS 3,567,995 A * 3/1971 Lauritzen et al. ..... 315/311
3,971,945 A * 7/1976 Franke ..... 378/96
4,072,865 A * 2/1978 Craig et al. ..... 378/110
4,158,138 A * 6/1979 Hellstrom ..... 378/116
4,170,735 A * 10/1979 Codina et al. ..... 378/96
4,646,338 A * 2/1987 Skillicorn ..... 378/110
4,930,145 A * 5/1990 Sherwin et al. ..... 378/109
6,233,310 B1 * 5/2001 Relihan et al. ..... 378/108
6,426,997 B1 * 7/2002 Fuchs et al. ..... 378/118
6,810,109 B2 * 10/2004 Chornenky ..... 378/108

* cited by examiner

*Primary Examiner*—Edward J. Glick
*Assistant Examiner*—Thomas R. Artman
(74) *Attorney, Agent, or Firm*—McNees Wallace & Nurick LLC

(57) ABSTRACT

An apparatus and method for an x-ray system includes an x-ray emitter having a first electrode and a second electrode. A high voltage supply is electrically connected to the first electrode. A power supply is electrically connected to the second electrode. A controller electrically connected to the high voltage supply and power supply is configured to provide a predetermined parameter to the second electrode during operation of the x-ray emitter to generate the predetermined dose rate from the x-ray emitter. During operation of the x-ray emitter, at least one operational value of the second electrode corresponding to the predetermined parameter is measured and combined with the predetermined parameter using an algorithm to obtain a modified predetermined parameter to be provided by the controller to the second electrode during a subsequent operation of the x-ray emitter.

35 Claims, 3 Drawing Sheets

METHOD TO CONTROL ANODIC CURRENT IN AN X-RAY SOURCE

FIELD OF THE INVENTION

The present invention is directed to x-ray systems, and more particularly, the present invention is directed to a method of controlling dental x-ray systems.

BACKGROUND OF THE INVENTION

In classic x-ray tubes used in radiography, free electrons must be made available so they can be accelerated by a high-voltage electric field, hit a target made of high-density, high-melting point metal (usually tungsten) attached to an electrode called an anode, and cause x-rays to be generated and emitted as a consequence of their rapid deceleration in the anodic target.

Such free electrons are produced by another electrode called a cathode (to which the negative pole of the high-voltage circuit is connected). Generally, electrons are freed from the cathode by thermal emission. To accomplish that, the cathode is usually in the form of a filament (also usually made out of tungsten) which is heated to glowing temperature through the passage of substantial electric current, called the filament current. In this way, the cathode (filament) simultaneously is associated with two different circuits, (i) the above-mentioned filament circuit, and (ii) the anodic circuit, across which the high voltage is applied for the electric field that accelerates the x-ray-yielding electrons.

The number of electrons emitted, and consequently the anodic current and the intensity of the x-ray beam that is generated, depends upon the temperature of the filament being elevated to a certain level by the electrical current. Therefore, the anodic current is a very steep function of the filament current. Consequently it is imperative that the filament current, and the operation of the filament circuit in general, be well controlled and regulated, in order to ensure a stable, consistent, and predictable anodic current and resultant x-ray intensity, or radiation dose rate.

One of the problems—indeed probably the most challenging to address—which must be resolved in order to implement such accurate regulation, occurs at the onset of the electron emission. At the quiescent state, if there is no current flowing through the filament, the filament is at an ambient temperature that is considerably lower than the filament temperature reached during emission of electrons and x-rays. Consequently, the filament electrical resistance is also much lower at an ambient temperature than during emission, since the electrical resistance in metals increases with an approximate linear dependence with the absolute temperature. As electrical power is applied, and the filament current begins to flow through the filament, its temperature and its resistance starts to increase, until a steady-state condition is reached where the amount of electrical power dissipated in the filament is in equilibrium with the thermal dissipation from the filament (which is also proportional to the temperature reached by the filament). Other second-order phenomena also affect this equilibrium condition, such as the power drain and temperature drop caused by the electrons of the anodic current being stripped away from the filament. Due to the thermal inertia of the filament, and the fact that its initial electrical resistance is low and so is the power it dissipates, normally it takes several hundreds of milliseconds for the x-ray tube to reach electrical equilibrium.

Consequently, if the filament of the x-ray tube is abruptly powered from ambient temperature, several tenths of a second may be required for the radiation output to rise to the desired, final level. This delay is undesirable especially with modern digital x-ray image receptors, which may require, or take advantage of, short exposure time, and consequently reduce the radiation dose to the patient.

In most modern x-ray source designs, where the filament circuit can be controlled and powered independently from the anodic circuit, during the quiescent state the filament is continuously powered with a moderate-intensity current (is "glowing"), that maintains the filament at an elevated temperature although the elevated temperature is less than the filament temperature achieved during emission. In this manner, the filament's electrical resistance is much higher than at ambient temperature, and it will respond much faster to a further rise of the applied electric power.

A further improvement, which is commonly adopted, is to boost the electrical power applied to the filament for a short time (e.g., a few hundredths of a second) before the application of the high voltage to the anodic circuit, in order to heat the filament to such a temperature that electronic current at the onset of the high-voltage corresponds substantially to the desired steady-state value that will settle within a few milliseconds. This is a called the preheating boost.

In order to accomplish a preheating boost, however, the preheating current or power to the filament usually needs to be accurately adjusted on an individual basis in each x-ray source. This individual adjustment is due to the very steep and critical dependence of the anodic current to an electrical current and temperature of the filament, as already mentioned, whereas minor physical and material differences between actual filaments and x-ray tubes (well within the constructive tolerances practically achievable) may lead to a significant difference among such onset anodic current.

Often, and especially in case of so called DC-supplied x-ray sources, the anodic current, and the filament power that controls it, is regulated through a feedback controlled loop. The feedback loop ensures that the anodic current ultimately settles to the target value. However, if the onset value is significantly different from the target (steady state) value, initially anodic current will be subject to large transitory fluctuations, such as shown in FIG. 1. Typically, such transitory fluctuations may last for several hundredths or even tenths of a second, which is a time frame incompatible with the short exposure time required with digital electronic image sensors, or even with "fast films". In the extreme case, such transitory fluctuations may bring anodic current out of scale, that is, beyond the range permitted by electrical safety controls, and cause the system to abort emission.

Consequently, even if the value of the anodic current is ultimately regulated through a feedback loop (acting upon the filament power via a nested loop), it is still necessary to accurately adjust the value of the preheating filament power (or current, or voltage), by calibrating for each individual x-ray source. Such calibration is critical and easily subject to operator errors.

Furthermore, if the target anodic current and/or the anodic high voltage (the "technique factors", as they are called in radiology) are not fixed to one value only (as is the case for most actual x-ray sources except most of those used for intraoral dental radiography) then such adjustment depends upon the specific technique factors selected for that emission. Such dependency is very direct for anodic current, but is affected also by the selected anodic high voltage. Consequently, even if a correction is applied to the preheating power to account for different technique factors, such correction may not operate exactly in the same manner, and equally well, in each individual unit.

In addition, such adjustment may not be stable as a result of changing environmental conditions, and may likely drift over the life span of the x-ray tube as a consequence of the filament aging. This problem has no known solution with the usual design in the current art, except performing regular calibration re-adjustments.

What is needed is a system and method for a dental x-ray device that automatically calibrates control parameters to the filament.

SUMMARY OF THE INVENTION

The present invention relates to a dental x-ray system including an x-ray emitter including a first electrode and a second electrode and a high voltage supply operatively connected to the first electrode. A power supply is electrically connected to the second electrode. A controller controls the high voltage supply and power supply to provide a predetermined dose rate from the x-ray emitter, the controller being configured to provide a predetermined parameter to the second electrode during operation of the x-ray emitter to generate the predetermined dose rate. During operation of the x-ray emitter, at least one operational value of the second electrode corresponding to the predetermined parameter is measured and combined with the predetermined parameter using an algorithm to obtain a modified predetermined parameter to be provided by the controller to the second electrode during a subsequent operation of the x-ray emitter.

The present invention further relates to a method for operating a dental x-ray system including the steps of providing an x-ray emitter including a first electrode and a second electrode, a high voltage supply electrically connected to the first electrode, a power supply electrically connected to the second electrode, and a controller electrically connected to the high voltage supply and power supply to provide a predetermined dose rate from the x-ray emitter. The method further includes providing a predetermined parameter by the controller to the second electrode during operation of the x-ray emitter to generate the predetermined dose rate and measuring at least one operative value of the second electrode corresponding to the predetermined parameter. The method further includes calculating a second predetermined parameter, and the controller initially providing the second predetermined parameter to the second electrode during a subsequent operation of the x-ray emitter.

The present invention further relates to an x-ray system including an x-ray emitter including an anode and a cathode. A high voltage supply is electrically connected to the anode and a power supply is electrically connected to the cathode. A controller controls the high voltage supply and power supply to provide a predetermined dose rate from the x-ray emitter, the controller being configured to provide a predetermined filament parameter to the cathode during operation of the x-ray emitter to generate the predetermined dose rate. During operation of the x-ray emitter, at least one operational value of the cathode corresponding to the predetermined filament parameter is measured and combined with the predetermined filament parameter using an algorithm to obtain a modified predetermined filament parameter to be provided by the controller to the cathode during a subsequent operation of the x-ray emitter.

An advantage of the present invention is that it can automatically calibrate a control parameter for a filament.

A further advantage of the present invention is that automatic calibration can be performed for different combinations of technique factors used with the dental x-ray device.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 2:
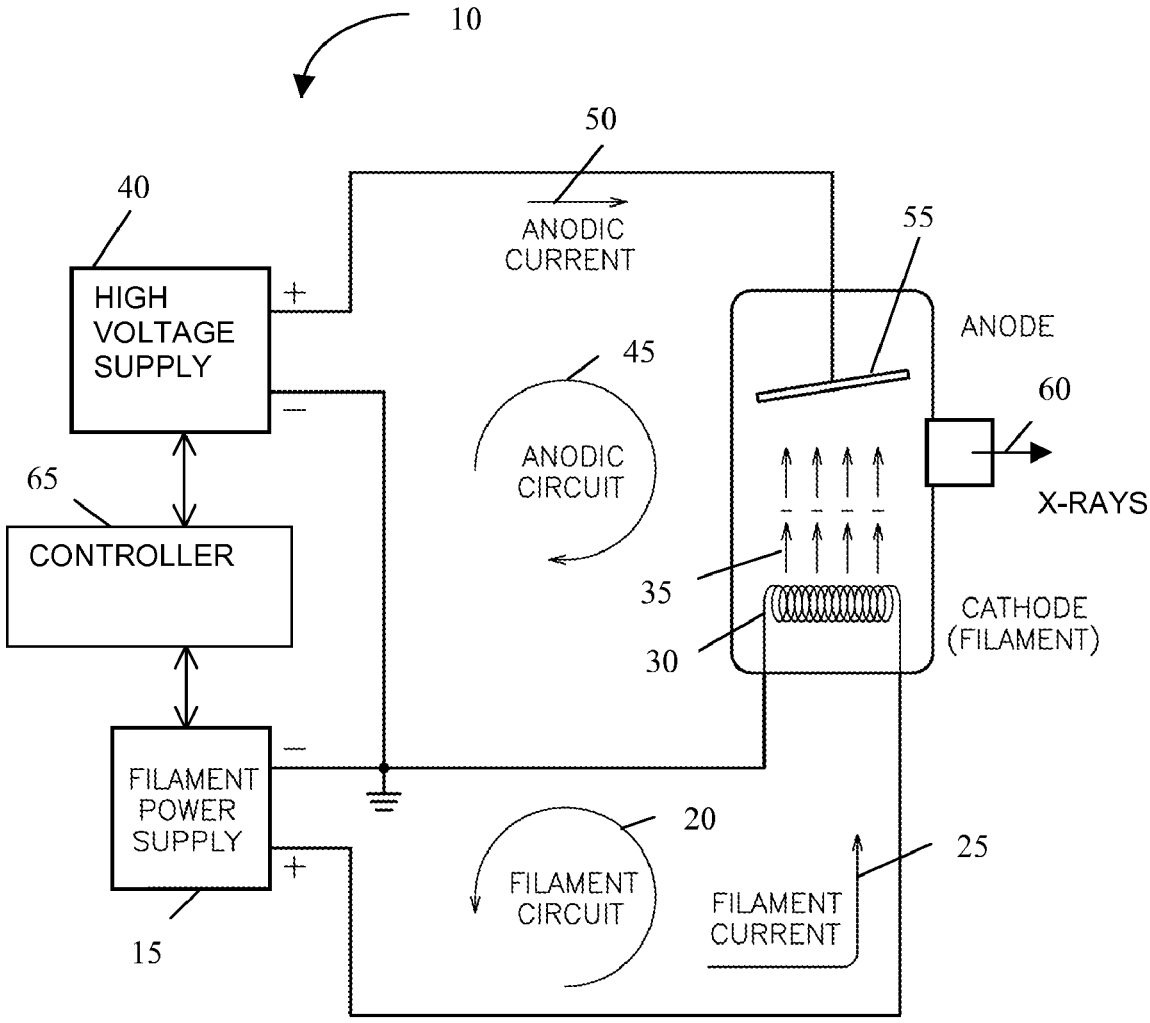
FIG. 2 is a schematic representation of an x-ray system of the present invention.

One embodiment of a dental apparatus 10 of the present invention is depicted in FIG. 2. Preferably, the dental apparatus 10 includes a filament power supply 15 that is a part of a filament circuit 20 through which a filament current 25 flows for selectively generating sufficient thermal energy in a filament 30, which is an electrode, so that free electrons 35 are emitted from the filament 30. A high voltage supply 40 is part of an anodic circuit 45 through which an anodic current 50 flows for selectively generating a high voltage between the filament 30 and an anode 55, which is an electrode. Preferably, the cathode 30 and a portion of the filament circuit 20 are associated with the anodic circuit 45. Typically, the anodic current 50 is in the order of several milli-Amperes, and filament current 25 is in the order of a few Amperes, as required to impart sufficient power to heat the filament 30, causing the emission of the electrons 35.

The high voltage produced by the high voltage supply 40 accelerates the electrons 35 emitted from the filament 30 for collision with the anode 55. In turn, the colliding electrons 35, being abruptly decelerated by the collision, release their kinetic energy by emitting x-ray photons 60, typically referred to as x-rays. The x-ray photons 60 are emitted at all directions, or angles, respect to the surface of the anode 55, but they are shielded by some suitable x-ray absorbing material in all directions except at a output opening, or collimating window; thus collimated, the x-ray photons constitute the useful x-rays. The x-rays pass through the target and a sensor (not shown) disposed on the opposite side of the target records the pattern of x-rays.

For proper operation of the dental apparatus 10, the number of free electrons 35 emitted, and consequently the anodic current 50 and the intensity of the x-ray beam that is generated, depends upon the temperature of the filament 30 being elevated to a certain power level. Therefore, the anodic current 50 is a very steep function of the filament current 25. Consequently it is imperative that the filament current 25, and the operation of the filament circuit 20 in general, be well controlled and regulated, in order to ensure a stable, consistent, and predictable anodic current 50 and consequent x-ray intensity, or radiation dose rate.

To achieve the desired control of the radiation dose rate and minimize the exposure time to a patient as previously described, a controller 65, which is preferably microprocessor controlled, is operatively connected to both the filament power supply 15 and the high voltage supply 40. The controller 65 controls the filament power supply 15 to provide a filament current 25 to the filament 30, thereby preheating the filament 30, prior to controlling the high voltage supply 40 to apply an anodic current 50 to the anode 55. (Note that in all considerations that follow, one could say either filament current or filament power, because they are mutually interdependent). Preferably, the controller 65 employs a feedback controlled loop to ensure that the anodic current 50 ultimately settles to a predetermined target value which can differ between various combinations of technique factors of the dental apparatus 10.

Figure 1:
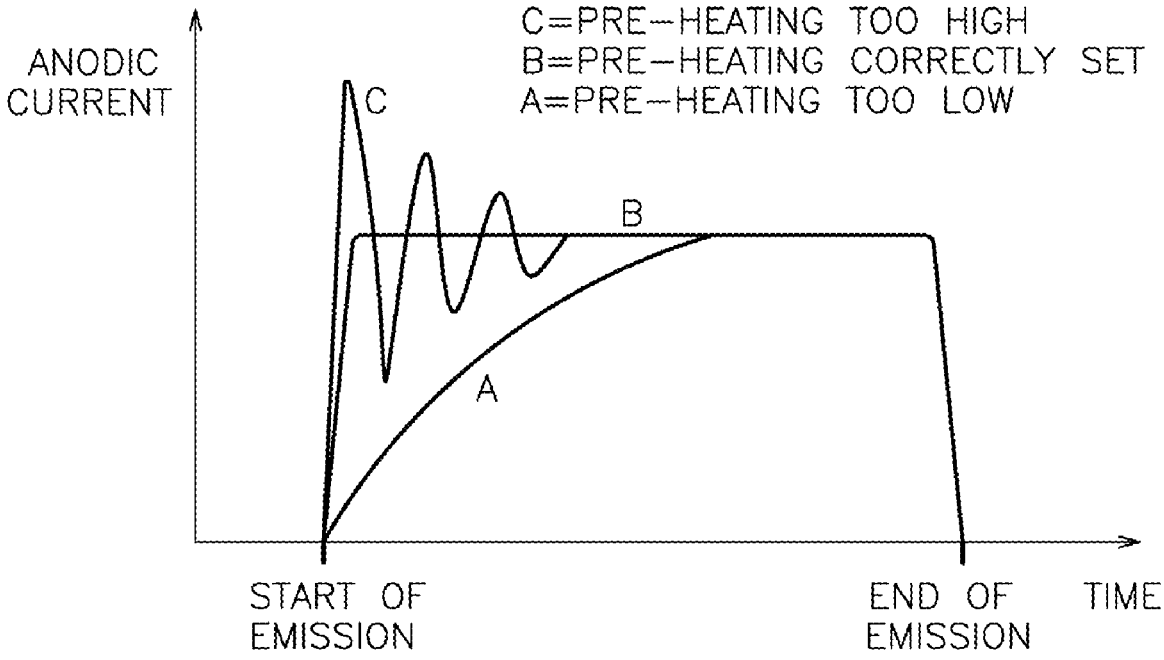
FIG. 1 is a graphical representation of anodic current over an x-ray emission cycle for multiple pre-heating configurations.

However, as also previously described and as shown in FIG. 1, even with a feedback controlled loop, if the onset anodic current 50 value is sufficiently different from the target (steady state) value, the preheat filament current (or power) that preheats the filament 30 must typically be adjusted for each individual dental apparatus 10. Preheat is the amount of filament current flowing in the filament, prior to the onset of the high voltage. Even if initial adjustment is not required, as the filament 30 ages, its electrical resistance changes, requiring further adjustment of the filament current 25. In either situation, if the filament current 25 is not adjusted properly, an undesirable transitory fluctuation can occur as shown in FIG. 1. To achieve an accurate regulation of the anodic current that is not subject to initial transitory fluctuation and is stable over the life of the equipment, the x-ray system 10 includes a processor, such as a digital microprocessor, and associated software and/or hardware to execute a self-tuning algorithm to monitor and correct the filament 30 preheat. The regulation, and the set point, for the filament power are implemented through the digital microprocessor as a nested feedback loop within the anodic current loop. The software executed by the microprocessor includes an algorithm for automatic determination of the preheating power, which involves one or more cycles of initial automatic calibration procedure.

Figure 3:
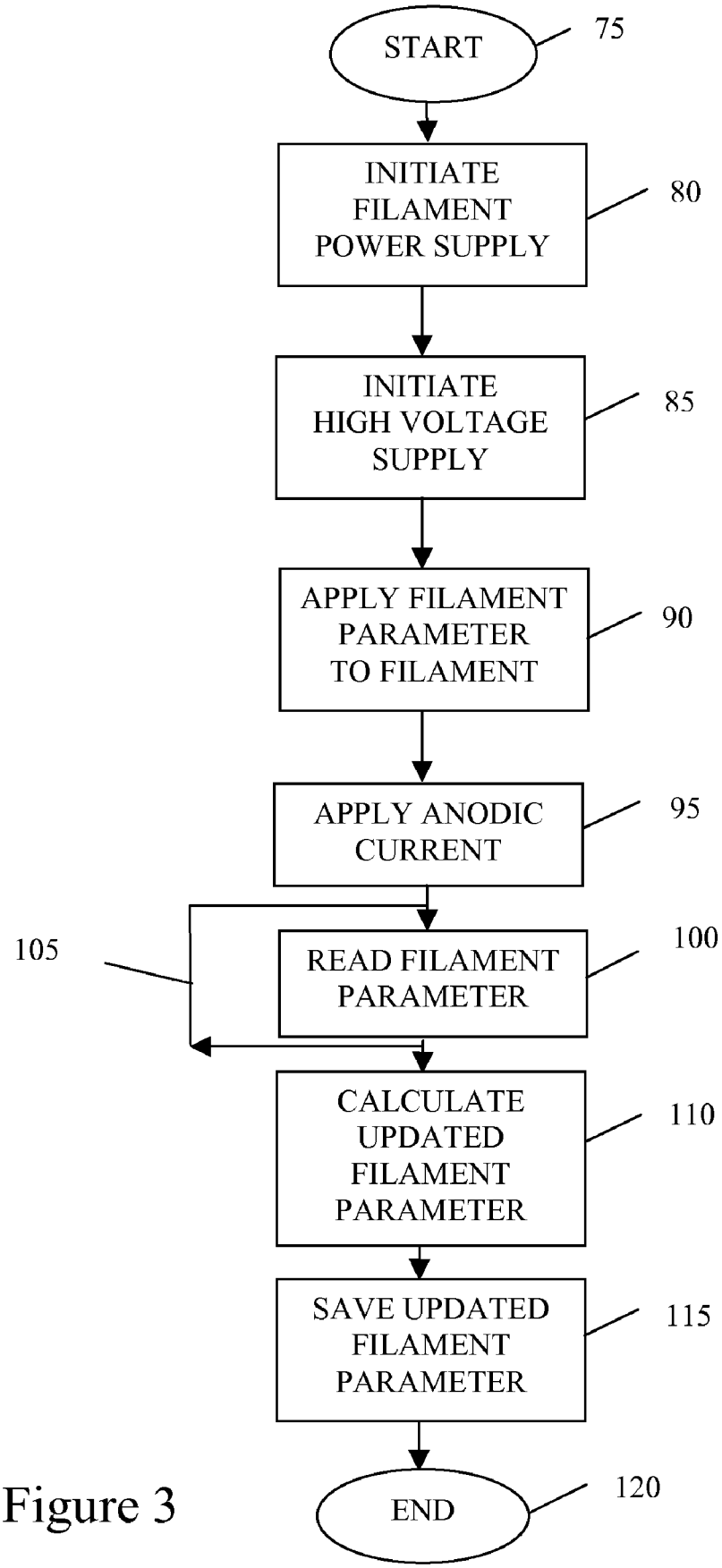
FIG. 3 is a flow chart of a control system for an x-ray system of the present invention.

The algorithm is discussed as shown in FIG. 3. Preferably, the dental apparatus 10 is initially started in step 75 for an x-ray emission or exposure, the filament 30 being in the nested-feedback loop for the anodic current 50, the filament power supply 15 and high voltage supply 40 being initiated in respective steps 80 and 85. Once steps 80 and 85 have occurred, a predetermined set-point filament value is initially applied in step 90 for one of the parameters (i.e., power, current or voltage) that determine the preheating of filament 30. This initial set point value is chosen to be as close as practical to the statistical average, out of many different x-ray sources, of the optimal value that is ultimately settled in by the algorithm described hereforth.

After the set-point filament parameter is applied in step 90, the anodic current 50 is applied in step 95. Once the anodic current 50 is applied, a set-point filament parameter value is read in step 100, preferably saved to memory, such as contained in the controller 65 or separate component, for subsequent use in the algorithm. During the exposure, after the anode current 50 has stabilized, typically about 400 to about 500 milliseconds after the start of the exposure, the anode current 50 is read and recorded by the microprocessor. Preferably, subsequent anode current values, such as eight, are recorded during the steady state operation of the exposure. Preferably, each of the values recorded during the exposure are then averaged together and this value is stored. The next time this technique is selected, this averaged and stored value is used by the preheat loop for the filament set point current. Preferably, a predetermined duration of time has elapsed from any one of the preceding steps (75, 80, 85, 90 or 95) prior to the occurrence of the reading step 100. It is to be understood that although step 100 may represent a single occurrence, an optional loop 105 is preferably employed so that more than one filament parameter set-point value is read or measured during the exposure period. Further, the duration of time between any subsequent filament parameter set-point values that are read in step 100 can be predetermined or can be a function of the difference in value between consecutive or nonconsecutive filament parameter readings. Similarly, the multiple filament parameter set-point readings are preferably saved to memory.

Once the single, or multiple, filament parameter set-point readings have been saved to memory in step 100, preferably at least one of these readings is combined with the filament parameter set-point value from step 90, with a calculation being performed in step 110. For example, in calculation step 110, these values can be combined to form an average, median, mean, or weighted calculated variation, or any other calculation, limited only by the formula used in step 110 for calculation. However obtained, the calculated filament parameter set-point value in step 110 becomes an updated filament parameter set-point value which is then saved in step 115 prior to termination of the process in step 120. The saved value from step 115 is then used in a subsequent operation of the x-ray system 10. After several x-ray emission operating cycles, the feedback loop causes the filament supply to settle to the proper set-point parameter value.

In an alternate embodiment, instead of simply calculating the value of the updated filament parameter set-point value obtained from step 110 from the initial provided filament parameter set-point value in step 90 and additional value(s) read in step 100, it may be desirable to continue to use earlier obtained set-point values from earlier operations of the x-ray system 10 in the calculation in step 110 to minimize the effects of a flawed single operation cycle, because the improper reading caused by a flawed operation is averaged with those from the much more frequent proper operations. Such flawed operation cycles could include those cycles in which interference, arcing, flash-over or other circumstance during which momentary fluctuation occurs. During an exposure, feedback signals are monitored against set point values. When the feedback signals are not equal to the set point values, within a predetermined range, error flags in the microprocessor are turned on. Preferably, the measured values from the flawed exposure are discarded and the earlier obtained set-point values from earlier operations of the x-ray system 10 are used.

This calibration process can be automatically repeated for all selectable combinations of technique factors used by the x-ray system 10 and the resulting set-points saved in a Look-Up Table (LUT).

If so needed, such automatic calibration can be initially repeated for more than one time, in order to establish an optimal LUT for the x-ray system 10 under calibration. Such an LUT is dynamically updated with the last regulated filament supply value at every emission, i.e., operation of the x-ray system 10. In this manner, any slight and gradual drift in the characteristics of the filament 30, and the x-ray system 10 in general, are prevented from affecting the filament 30 preheating, since the system is automatically re-calibrated at each subsequent x-ray emission cycle. Alternately, the calculation may disregard values from a flawed operation cycle if the values saved from any single operation sufficiently differ from the average of those of earlier operations of the x-ray system 10.

The LUT serves a dual purpose by recording the appropriate values during initial setup and continually correcting those values with each use. The LUT provides an additional bonus, should the system in the future need a replacement head, in that a field technician will be able to run the filament preheat algorithm. That is, after completion of the preheat algorithm, the replacement head and the system will be fully calibrated for anode (target) current at each of the systems techniques.

Those skilled in the art can appreciate that while the preferred embodiment is directed to a dental x-ray system, the present invention can be used with any x-ray system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An x-ray system comprising:

an x-ray emitter including a first electrode and a second electrode;

a high voltage supply electrically connected to the first electrode;

a power supply electrically connected to the second electrode;

a controller to control the high voltage supply and power supply to provide a predetermined dose rate from the x-ray emitter, the controller being configured to provide a predetermined parameter to the second electrode during operation of the x-ray emitter to generate the predetermined dose rate;

wherein during operation of the x-ray emitter, at least one operational value of the second electrode corresponding to the predetermined parameter is measured and combined with the predetermined parameter using an algorithm to obtain a modified predetermined parameter to be provided by the controller to the second electrode during a subsequent operation of the x-ray emitter; and the at least one operational value from a flawed operation of the x-ray system is disregarded and the modified predetermined parameter is the modified predetermined parameter from a previous operation of the x-ray system.

2. The x-ray system of claim 1 wherein the predetermined parameter is electrical power.

3. The x-ray system of claim 2 wherein the at least one operational value is a plurality of operational values, the plurality of operational values being statistically averaged before being combined with the predetermined parameter.

4. The x-ray system of claim 1 wherein the predetermined parameter is electrical current.

5. The x-ray system of claim 4 wherein the at least one operational value is a plurality of operational values, the plurality of operational values being statistically averaged before being combined with the predetermined parameter.

6. The x-ray system of claim 1 wherein the predetermined parameter is electrical voltage.

7. The x-ray system of claim 6 wherein the at least one operational value is a plurality of operational values, the plurality of operational values being statistically averaged before being combined with the predetermined parameter.

8. The x-ray system of claim 1 wherein the at least one operational value is measured at predetermined time increments.

9. The x-ray system of claim 8 wherein the predetermined time increments are a function of a difference in value between consecutive measurements of operational values.

10. The x-ray system of claim 8 wherein the predetermined time increments are a function of a difference in value between non-consecutive measurements of operational values.

11. The x-ray system of claim 1 wherein the modified predetermined parameter is an average of the predetermined parameter and the at least one operational value.

12. The x-ray system of claim 1 wherein the modified predetermined parameter is a median of the predetermined parameter and the at least one operational value.

13. The x-ray system of claim 1 wherein the modified predetermined parameter is a mean of the predetermined parameter and the at least one operational value.

14. The x-ray system of claim 1 wherein the modified predetermined parameter is one of a weighted calculated variation of an average, a mean or a median of the predetermined parameter and the at least one operational value.

15. The x-ray system of claim 1 wherein the modified predetermined parameter is a combination of a plurality of previously modified predetermined parameters from previous operations of the x-ray emitter and the at least one operational value.

16. The x-ray system of claim 1 wherein the controller determines a flawed operation of the x-ray system by comparing the at least one operational value to an average of previous modified predetermined parameters.

17. The x-ray system of claim 1 wherein the controller includes a look-up table to store the modified predetermined parameter.

18. A method for operating an x-ray system comprising the steps of:

providing an x-ray emitter including a first electrode and a second electrode, a high voltage supply electrically connected to the first electrode, a power supply electrically connected to the second electrode;

electrically connecting a controller to the high voltage supply and power supply to provide a predetermined dose rate from the x-ray emitter;

providing a predetermined parameter by the controller to the second electrode during operation of the x-ray emitter to generate the predetermined dose rate;

measuring at least one operative value of the second electrode corresponding to the predetermined parameter;

calculating a second predetermined parameter;

disregarding the at least one operational value in response to a flawed operation of the x-ray system and assigning the second predetermined parameter to be the second predetermined parameter from a previous operation of the x-ray system; and the controller providing the second predetermined parameter to the second electrode during a subsequent operation of the x-ray emitter.

19. The method of claim 18 wherein the predetermined parameter is electrical power.

20. The method of claim 19 wherein the at least one operative value is a plurality of operational values, the plurality of operational values being statistically averaged and used to calculate the second predetermined parameter.

21. The method of claim 18 wherein the predetermined parameter is electrical current.

22. The method of claim 21 wherein the at least one operative value is a plurality of operational values, the plurality of operational values being statistically averaged and used to calculate the second predetermined parameter.

23. The method of claim 18 wherein the predetermined parameter is electrical voltage.

24. The method of claim 23 wherein the at least one operative value is a plurality of operational values, the plurality of operational values being statistically averaged and used to calculate the second predetermined parameter.

25. The method of claim 18 wherein the at least one operative value is measured at predetermined time increments.

26. The method of claim 25 wherein the predetermined time increments are a function of a difference in value between consecutive measurements of operational values.

27. The method of claim 25 wherein the predetermined time increments are a function of a difference in value between non-consecutive measurements of operational values.

28. The method of claim 18 wherein the second predetermined parameter is an average of the predetermined parameter and the at least one operational value.

29. The method of claim 18 wherein the second predetermined parameter is a median of the predetermined parameter and the at least one operational value.

30. The method of claim 18 wherein the second predetermined parameter is a mean of the predetermined parameter and the at least one operational value.

31. The method of claim 18 wherein the second predetermined parameter is one of a weighted calculated variation of an average, a mean or a median of the predetermined parameter and the at least one operational value.

32. The method of claim 18 wherein the second predetermined parameter is a combination of a plurality of previously modified predetermined parameters from previous operations of the x-ray emitter and the at least one operational value.

33. The method of claim 18 further comprising comparing the at least one operational value to a corresponding setpoint value to determine a flawed operation of the x-ray system.

34. The method of claim 18 wherein the controller includes a look-up table to store the second predetermined parameter.

35. An x-ray system comprising:

an x-ray emitter including an anode and a cathode;

a high voltage supply electrically connected to the anode;

a power supply electrically connected to the cathode;

a controller to control the high voltage supply and power supply to provide a predetermined dose rate from the x-ray emitter, the controller being configured to provide a predetermined filament parameter to the cathode during operation of the x-ray emitter to generate the predetermined dose rate;

wherein during operation of the x-ray emitter, at least one operational value of the cathode corresponding to the predetermined filament parameter is measured at predetermined time increments and combined with the predetermined filament parameter using an algorithm to obtain a modified predetermined filament parameter to be provided by the controller to the cathode during a subsequent operation of the x-ray emitter; and the predetermined time increments are a function of a difference in value between one of consecutive measurements of operational values or non-consecutive measurements of operational values.

* * * * *